US005979170A

United States Patent [19]

Thorpe

[11] Patent Number: 5,979,170

[45] Date of Patent: Nov. 9, 1999

[54] COOLING BULK STORED FOOD GRAINS

[75] Inventor: Graham R Thorpe, Brighton East, Australia

[73] Assignee: Victoria University of Technology, Melbourne, Australia

[21] Appl. No.: 08/974,851

[22] Filed: Nov. 20, 1997

[30] Foreign Application Priority Data

Nov. 20, 1996 [AU] Australia ..... PO3761

[51] Int. Cl.[6] ..... F25D 23/00

[52] U.S. Cl. ..... 62/271; 62/92; 62/93; 62/94; 34/473

[58] Field of Search ..... 62/271, 94, 92, 62/93, 473, 472, 81, 88

[56] References Cited

U.S. PATENT DOCUMENTS

| | | | |
|---|---|---|---|
| 5,653,115 | 8/1997 | Brickley et al. | 62/271 |
| 5,749,230 | 5/1998 | Coellner et al. | 62/271 |
| 5,758,508 | 6/1998 | Belding et al. | 62/271 |

OTHER PUBLICATIONS

The Performance of a Solar–Regenerated Open–Cycle Desiccant Bed Grain Cooling System—M. Zainai Ismail, D.E. Anous, and G. R. Thorpe; Solar Energy vol. 46, No. 2, pp. 63–70, 1991.

*Primary Examiner*—Henry Bennett
*Assistant Examiner*—Melvin Jones
*Attorney, Agent, or Firm*—Andrus, Sceales, Starke & Sawall

[57] ABSTRACT

An apparatus for producing dried and dehumidified cooling air for bulk stored grains and other produce from which moisture evaporates comprising a multiplicity of narrow elongate beds 2 of desiccant between which a multiplicity of heat exchange channels 3 providing heat exchange surfaces 4 in contact with each bed 2 of desiccant are provided. Air to be treated is passed through the beds 2 of desiccant while secondary air is forced through the heat exchange channels 3 to cool and remove the heat of sorption collected by the desiccant from the air being treated. desiccant can be regenerated by passing heated air through the beds.

12 Claims, 3 Drawing Sheets

COOLING BULK STORED FOOD GRAINS

FIELD OF THE INVENTION

This invention relates to the cooling of bulk food grains and other produce from which moisture evaporates, and more particularly to a novel system for producing cooling air which allows the grains or other produce to be cooled in an effective manner.

BACKGROUND OF THE INVENTION

There is increasing pressure for grain growers to present their produce onto domestic and international markets in good condition, free from live insect pests and free from chemical pesticides. The marketing requirement that the grain must be free from chemical pesticides arises for two reasons. Firstly, insects inevitably become resistant to chemicals hence increasing dosages and/or new pesticides must continue to be developed. Secondly, consumers are becoming increasingly intolerant of chemicals being admixed with foodstuffs. As a result of these pressures, engineering, as opposed to chemical solutions, are sought to the problems of grain storage.

In Australia, grains are harvested quite warm, typically with a temperature of 30° C., although this is quite variable. Such temperatures at harvest time are conducive to the rapid growth of insect populations. Further more, they are sufficiently high to cause the rapid degradation of desirable grain properties, such as those required for bread making or for malting barley. One way of reducing these problems is to cool the grains, which confers the following benefits to storers and handlers of grains:

- cooling slows or reduces the rate at which insect populations grow;
- desirable grain properties such as germination and baking quality are preserved;
- in cases in which chemical pesticides are applied to grains, cooling slows their rite of decay, and makes the rate of loss more predictable;
- by reducing temperature gradients in the grain bulk, free convection currents are reduced that transport moisture from warm regions of a grain bulk to cooler regions;
- by slowing down the rate of fungal activity, cooling allows damp grain to be stored for longer periods of time before it is dried.

A convenient method of cooling bulk stored grains is to force ambient air through the grain, usually during the night when the ambient temperature is low. However, since food grains are hygroscopic they adsorb moisture from the air, and heat is liberated as a result of moisture condensing on the grains. As a consequence, the grains do not generally cool down to the temperature of ambient air, and generally the so-called dwell temperature of the grains is higher than ambient temperature. For example, wheat with an initial moisture content of 11% will cool only to about 27° C. when ventilated with air with a temperature of 20° C. and relative humidity of 90%. The crier the grains, and the more humid the climate the more difficult it is to cool the grains. One way of cooling grains further is to ventilate them with air that has been cooled by a conventional vapour compression air refrigeration unit, typical of those used to air condition buildings. A second method is to ventilate the grains with air that has a temperature close to ambient temperature, but which has been dried or dehumidified. The low humidity air causes a very small proportion of the grain to dry, and this absorbs latent heat of vaporisation which causes the grain bulk to cool. For example, wheat with an initial moisture content of 11% will cool to about 16° C. when ventilated with air that has a temperature of 20° C. and a relative humidity of 20%.

Desiccants have been used to condition air that is subsequently used to cool buildings during the day. Such systems often manifest themselves as rotating dehumidifying wheels in which the desiccant in one half of the wheel is used to dry air, whilst the desiccant in the other half of the rotating wheel is being regenerated. After the air has been dried it is usually cooled by injecting water sprays into it. This air is unsuitable for cooling grains because its enthalpy is little changed by its being cooled, and its high relative humidity prevents the stored grains from cooling, as described above.

An open-cycle desiccant bed system for cooling food grains has been described by Ismail, Angus and Thorpe (Ismail, M. Z., Angus, D. E. and Thorpe, G. R. (1991) The performance of a solar regenerated desiccant bed grain cooling system. *Solar Energy Journal,* 46(2), pp 63–70). In this system, ambient air is dried during the night in two separated desiccant beds arranged in series in the air flow, and the heat of sorption is reduced by natural convection in a multistage process by passing the air over heat exchanger means after it exits from each bed of desiccant. During the day, the heat exchangers act as solar collectors and they are used to heat ambient air that is then used to regenerate the desiccant. This device reduces the humidity of ambient air but the air flow rate is limited to about 4 liters per second per square meter of heat exchanger area. One reason for this is that the overall heat transfer coefficient from the heat exchanger surfaces is low. As a result, it is difficult to dissipate the heat of sorption to the atmosphere. Furthermore, the desiccant beds need to be quite deep to ensure the velocity of the air that flows through them is sufficiently low to maintain a low pressure drop across the device. This large depth limits the rate at which heat can be dissipated from the desiccant beds, and as a result, the beds do not operate isothermally.

SUMMARY OF INVENTION AND OBJECT

It is an object of the present invention to provide an apparatus and process for producing cooling air for stored grains and other produce from which moisture evaporates, in which the desiccant beds are arranged to reduce the humidity of the cooling air in a substantially isothermal manner.

The invention provides an apparatus for producing dried and dehumidified cooling air for bulk stored grains and other produce from which moisture evaporates and which requires cooling, including means for producing an ambient air stream, desiccant bed means positioned in the air stream arid through which the air stream is adapted to be passed for conditioning, and means for cooling the desiccant bed means to reduce or remove the heat of sorption liberated when moisture in the air stream adsorbed by the desiccant is dissipated to the atmosphere.

In this way, the humidity of the ambient air in the air stream is reduced in a substantially isothermal manner. This is an improvement over conventional grain aeration or cooling systems in which ambient air is passed directly through the grain and the heat of sorption is liberated in the grain mass, thus preventing the grain from cooling to ambient temperature.

In a preferred form of the invention, the desiccant bed means include means defining narrow elongate beds of desiccant separated by heat exchanger means through which cooling medium, such as air, is passed to cool the beds of desiccant to extract the heat of sorption from the desiccant. By dividing the desiccant into narrow beds, the rate of heat transfer from the beds is significantly improved. For example, compared to the arrangement described in the paper by Ismail, Angus and Thorpe, referred to above, in which the heat adsorption is inefficiently extracted from the air by internal convection, rather than directly from the beds of desiccant, a tenfold rate of heat transfer from the desiccant beds is achieved.

The apparatus according to the invention preferably includes means for delivering heated air to lie desiccant beds to regenerate the desiccant beds, and means for venting the air to atmosphere after it has passed through the desiccant beds.

The invention also provides a system for cooling grains and other produce from which moisture, evaporates, comprising an apparatus as defined above in combination with a storage means containing produce to which air cooled by the apparatus is delivered.

The invention also provides a process for producing cooling air for stored grains and other produce from which moisture evaporates, comprising the steps of passing ambient air through desiccant bed means, and cooling the desiccant in the bed means to reduce its humidity in a substantially isothermal manner.

BRIEF DESCRIPTION OF THE DRAWINGS

In order that the invention may be more readily understood, one presently preferred embodiment of the invention will now be described with reference to the accompanying drawings in which.

DESCRIPTION OF PREFERRED EMBODIMENT

Figure 1:
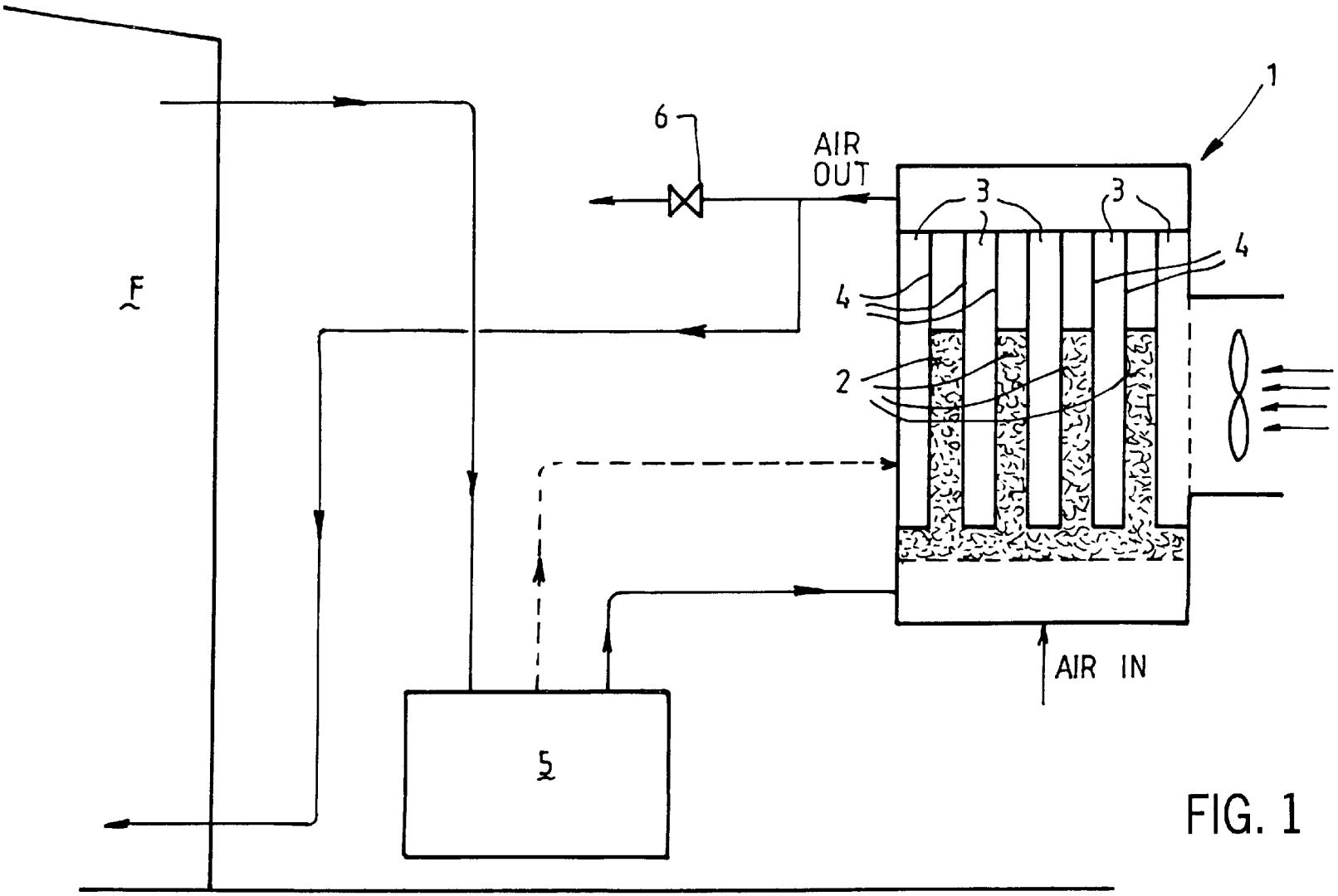
FIG. 1 is a schematic diagram of an air cooling system embodying the invention.

Referring to FIG. 1, the air cooling apparatus embodying the invention includes a cooling unit 1 housing a multiplicity of narrow elongate beds 2 of desiccant between which a multiplicity of heat exchange channels 3 providing heat exchange surfaces 4 in contact with each bed 2 of desiccant are provided. In this embodiment, the heat exchange surfaces 4 serve to define the narrow beds 2 of desiccant. Air to be treated is passed through the beds 2 of desiccant while secondary air is forced through the heat exchange charnels 3 to cool and remove the heat of sorption collected by the desiccant from the air being treated.

The air conditioning cycle has two modes of operation, namely a cooling cycle and a regeneration cycle. In the cooling cycle, air is dehumidified by means of the desiccant beds 2 located in the cooling unit 1. There is no restriction on the nature of the desiccant, but it may take the form of beads of silica gel, or comprise a naturally occurring desiccant such as food grains or wool. The heat of sorption is removed from the desiccant by forcing cool secondary air across the heat exchange surfaces 4 of the channels 3 located within the cooling unit 1. The cool, dry air leaving the desiccant (air out) is forced into a food store F where it is used to cool the produce. This process usually, though not necessarily, occurs during the night when the temperature of both the air used to cool the produce and the secondary cooling air are likely to be at their lowest.

Figure 2:
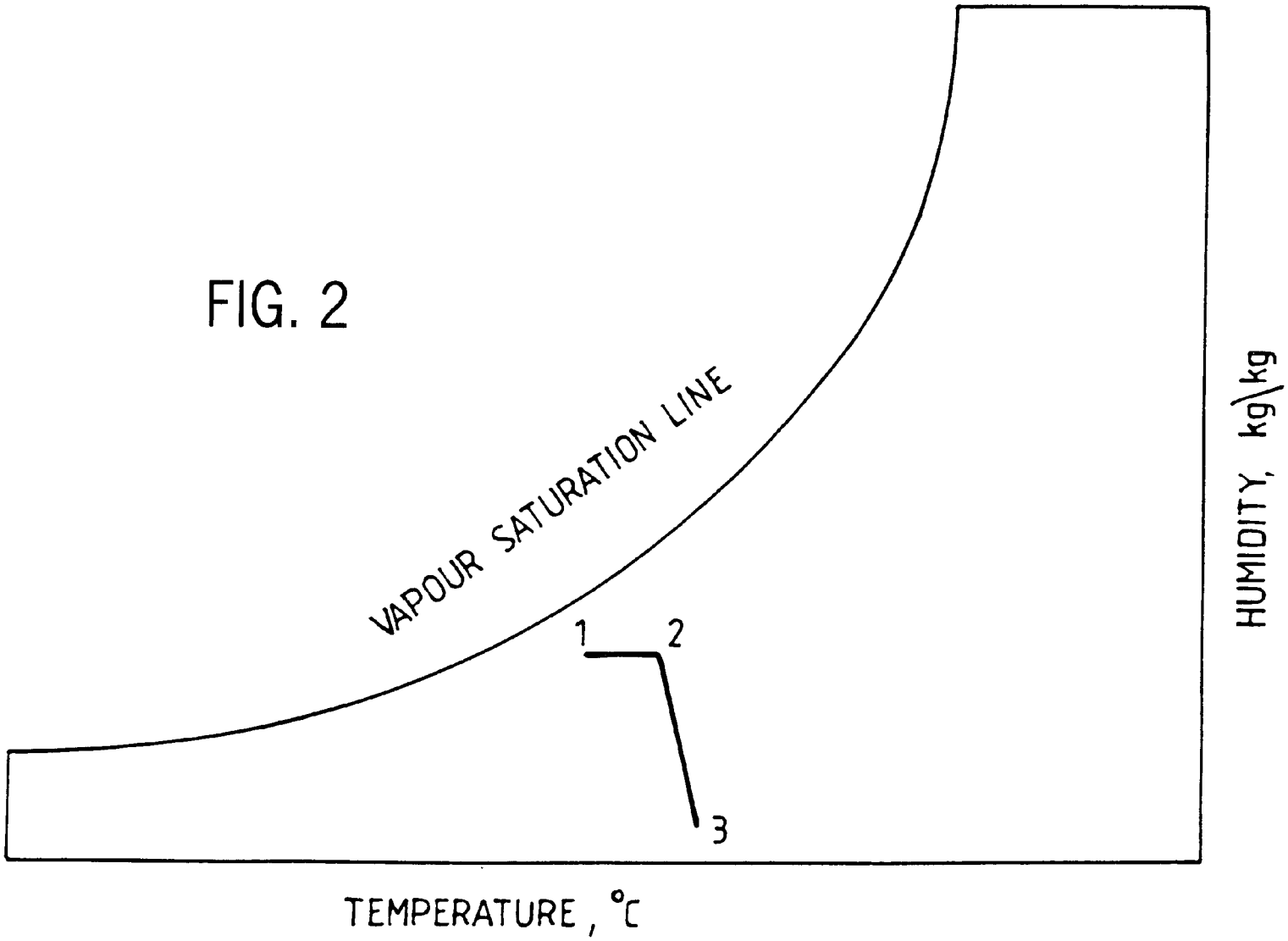
FIG. 2 is a schematic diagram of the thermodynamic states of the process air during cooling.

The thermodynamic states of the air during the dehumidifying and cooling processes are shown schematically in FIG. 2 of the drawings, for one possible configuration of the system.

In the regeneration cycle, the moistened desiccant is regenerated, usually during the day, using air with a low relative humidity. The air may be drawn from a source of energy, such as the roof area of the food store, which may be subject to solar radiation, or it may be ambient air. The relative humidity of the air may be further reduced by means of an air heater 5, using solar or some other form of energy, before it is forced through the desiccant. The warm humid air is not fed into the food store for cooling purposes, but it may be directed for some other use, using a valve 6, say, as shown in FIG. 1. If necessary, the desiccant may be indirectly heated, as indicated by the dotted line in FIG. 1, by forcing heated air into contact with the heat exchanger surfaces 4 to ensure that the desiccant is dried to a low moisture content. The energy used to heat this air stream may arise from many sources, one of which could be the flue gases expelled from a gas burner. This helps to ensure that all the regions of the desiccant, which are enclosed between the heat exchanger surfaces, remain at a sufficiently high temperature for the desiccant to dry to a sufficiently low moisture content.

Figure 3:
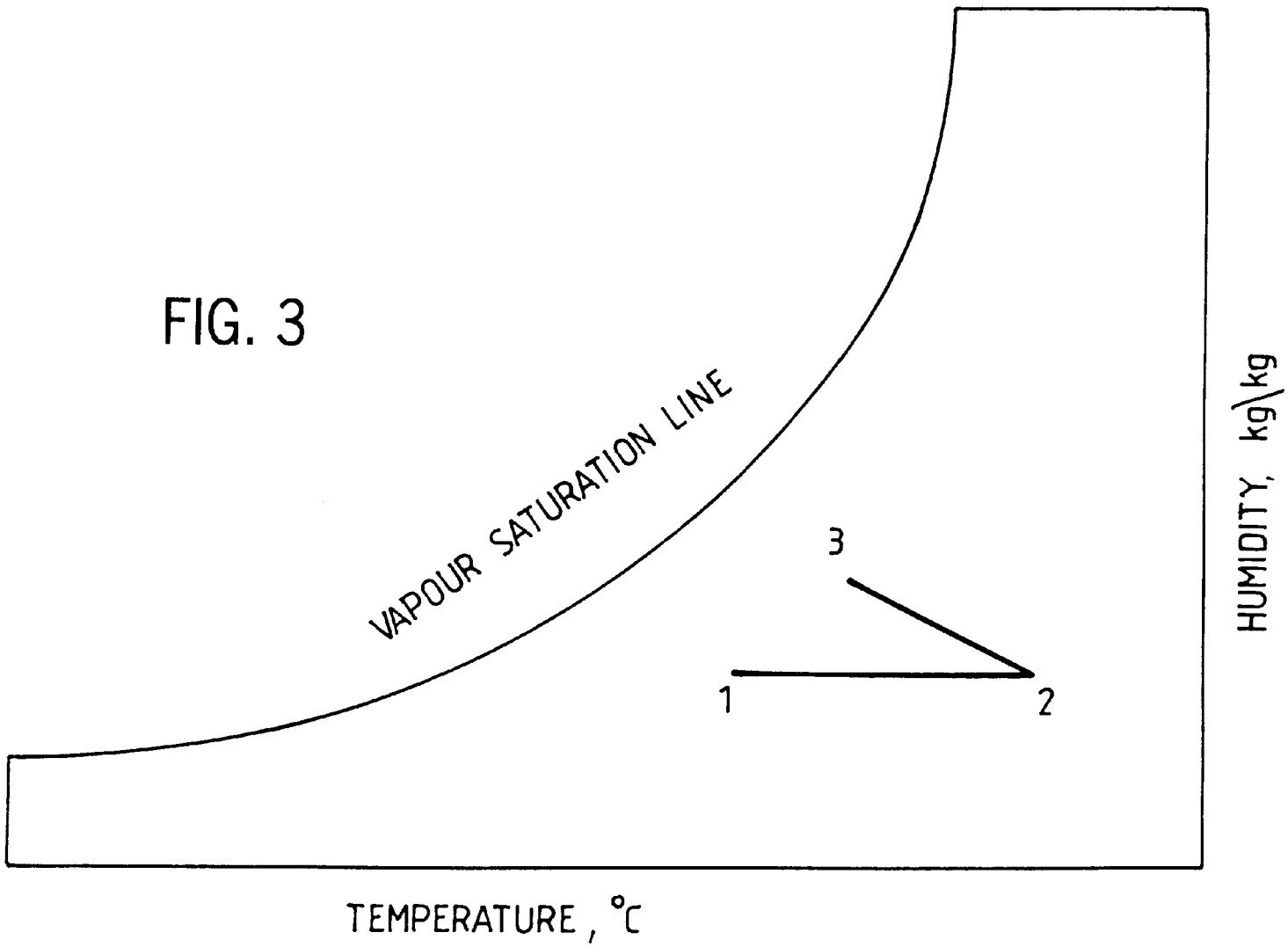
FIG. 3 is a schematic diagram showing the thermodynamic states of the air used to regenerate the desiccant.

The thermodynamic states of the air during the regeneration process are shown schematically in FIG. 3, for one possible configuration of the system.

An effective grain cooling system should preferably be such that the air flow rare is typically about one liter per second per tonne of grain cooled, and the cooling system should operate for about three to five hours in every twenty four hours. The cooling can be carried out during the day, or during the night, whichever is more convenient.

Preliminary experiments have been performed on a novel grain cooling system, embodying the invention, and the following results have been obtained during the cooling cycles:

| Air flow rate kg/s | Inlet dry-bulb temperature ° C. | Inlet wet-bulb temperature ° C. | Outlet dry-bulb temperature ° C. | Outlet wet-bulb temperature ° C. |
|---|---|---|---|---|
| 0.22 | 21.4 | 17.0 | 24.0 | 13.2 |
| 0.11 | 18.7 | 17.1 | 15.4 | 8.0 |
| 0.11 | 19.9 | 18.3 | 16.3 | 7.8 |
| 0.16 | 19.5 | 17.0 | 19.0 | 8.2 |

It will be appreciated from the above that novel features of the open-cycle desiccant cooling system embodying the invention include:

(i) No system similar to that described above for cooling food grains has been described or used before;

(ii) The desiccant bed is cooled by forced convection using heat transfer surfaces before the dehumidified air is used to cool food grains and other agricultural produce by means of evaporative cooling.

(iii) The desiccant is contained between heat exchanger surfaces that are disposed in such a manner that heat transfer through the desiccant is sufficiently rapid to ensure that the desiccant bed operates substantially isothermally.

(iv) The system allows for air to be heated in the roof region of a store or building before it is used to dry the desiccant.

(v) Heated air may also be forced across external heat exchanger surfaces that contain desiccant to ensure that the desiccant is dried to a low moisture content.

What is claimed is:

1. An apparatus for producing dried and dehumidified cooling air for stored grains and other produce from which moisture evaporates, said apparatus comprising:

means for producing a stream of ambient air;

desiccant bed means positioned in the air stream and through which the air stream passes for drying and dehumidification, said desiccant bed means comprising a plurality of spaced beds filled with desiccant material, said beds being elongated in a first dimension and having a second dimension normal to said first dimension which is less than said first dimension, said bed means having heat exchange channels formed between adjacent, spaced beds of said plurality of beds, said beds and heat exchange channels being separated by heat transfer surface members lying therebetween, said heat transfer surface members being in contact with said desiccant material in said beds; and means for supplying a cooling medium to said heat exchange channels formed between said adjacent desiccant material beds to remove the heat of sorption from said desiccant material across said heat transfer surface members, said heat of sorption being liberated in the beds when moisture in the air stream is adsorbed by the desiccant.

2. The apparatus of claim 1, further including means for delivering heated air to the desiccant bed means to regenerate the desiccant, and means for venting the air to atmosphere after it has passed through the desiccant.

3. The apparatus of claim 2 further including means delivering heated air to said heat exchange channels to transfer heat across said heat transfer surface members to regenerate the desiccant material beds.

4. The apparatus of claim 1 further including means delivering heated air to said heat exchange channels to transfer heat across said heat transfer surface members to regenerate the desiccant material beds.

5. The apparatus of claim 1 further including storage means for the grains or other produce and means for providing the dried and dehumidified cooling air to said storage means.

6. The apparatus of claim 1 wherein said cooling medium supply means is further defined as a means for supplying a cooling medium comprising air.

7. A process for producing dried and dehumidified cooling air for stored grains and other produce from which moisture evaporates, said method comprising the steps of:

providing a stream of ambient air;

passing the ambient air through desiccant material contained in a plurality of spaced beds, the passage of air through the beds occurring generally in parallel, said beds being elongated in a first dimension and having a second dimension normal to said first dimension which is less than said first dimension, said beds having heat exchange channels interposed between adjacent beds, said beds and heat exchange channels being separated by heat transfer surface members lying therebetween, said heat transfer surface members being in contact with the desiccant material in said beds; and supplying a cooling medium to the heat exchange channels simultaneously with passing the ambient air for extracting the heat of sorption from the desiccant material in said beds across the heat transfer surface members to cool the desiccant material and reduce the humidity of the air stream in a substantially isothermal manner.

8. The process of claim 7 further defined as one for cooling stored grain or other produce and including the step of passing the dried and dehumidified air through the stored grain or other produce, the passage of the air removing the heat of vaporization and drying at least a portion of the grain or produce, thereby evaporatively cooling adjacent portions of the grain or produce.

9. The process of claim 7 further including the step of delivering heated air to the desiccant material beds to regenerate the desiccant and venting the air to atmosphere after it has passed through the desiccant.

10. The process of claim 9 further including the step of delivering heated air to the heat exchange passages to transfer heat across the heat transfer surface members to regenerate the desiccant material in the beds.

11. The process of claim 9 further including the step of delivering heated air to the heat exchange passages to transfer heat across the heat transfer surface members to regenerate the desiccant material in the beds.

12. The process of claim 7 wherein the step of supplying a cooling medium is further defined as supplying a cooling medium comprising air.

* * * * *